US005135612A

United States Patent [19]

Desrochers et al.

[11] Patent Number: 5,135,612

[45] Date of Patent: Aug. 4, 1992

[54] METHODS FOR MAKING EXPLODED BARK PRODUCTS

[75] Inventors: Michel J. Desrochers, Dollard des Ormeaux; Michel Jean, Pointe Claire; Michel P. Drouin, Ile Perrot, all of Canada

[73] Assignee: Domtar Inc., Montreal, Canada

[21] Appl. No.: 667,697

[22] Filed: Mar. 11, 1991

Related U.S. Application Data

[62] Division of Ser. No. 468,347, Jan. 22, 1990, Pat. No. 5,021,122.

[51] Int. Cl.[5] ..... D21H 11/00

[52] U.S. Cl. ..... 162/11; 162/13; 162/21; 162/93; 162/163

[58] Field of Search ..... 162/10-13, 162/18, 21, 93, 103, 150, 163, 165, 181.3, 181.6, 225; 264/124

[56] References Cited

U.S. PATENT DOCUMENTS

| | | | |
|---|---|---|---|
| 1,663,503 | 3/1928 | Mason | 162/21 |
| 3,984,363 | 10/1976 | D'Alelio | 530/502 |
| 4,879,066 | 11/1989 | Crompton | 427/419.6 |

*Primary Examiner*—Richard V. Fisher
*Assistant Examiner*—Charles K. Friedman

[57] ABSTRACT

A method for making a shaped product comprising exploded bark. Preferably the shaped product comprises exploded softwood bark having at least 23% cellulose and at least 18% lignin and polyphenols content, based upon the dry weight basis of the bark. One of the methods to make the shaped product comprises exploding softwood bark to obtain exploded softwood bark having at least 23% cellulose and at least 18% lignin and polyphenols content, compressing that exploded bark into a shaped product, while removing in part water, and drying the shaped product to remove the remaining water.

16 Claims, 1 Drawing Sheet

FLEXURAL STRENGTH IN PSI
500
480
460
440
420
400
380
360
340
320
300
280
260
240
220
0
10
20
30
% BY WEIGHT OF EXPLODED SOFTWOOD BARK PRESENT WITH THE REMAINING PERCENT OF WOOD FIBERS

FLEXURAL STRENGTH (PSI)
140
120
100
80
60
40
20
0
0:100
5:95
15:85
25:75
35:65
% BY WEIGHT OF EXPLODED HARDWOOD BARK PRESENT WITH THE REMAINING % BEING WOOD FIBERS

METHODS FOR MAKING EXPLODED BARK PRODUCTS

Reference to related application:

This is a division of application 07/468,347, filed Jan. 22, 1990, now U.S. Pat. No. 5,021,122.

FIELD OF THE INVENTION

This invention relates to shaped products comprising exploded bark, preferably softwood bark and most preferably softwood bark having at least 23% cellulose content and at least 18% lignin and polyphenols content, said percent being on the dry weight basis of said bark, and particularly boards of exploded barks hereinafter referred to as: "exploded bark boards" and to the methods of making same, where in the bark so exploded, the cellulose content as well as the lignin and the polyphenols contents are maximized.

This invention is also directed to methods for making same as defined hereinabove, and particularly those for making exploded bark boards with or without compatible fragmented material adjuncts, and preferably boards having improved flexural strength and low water absorption as compared with conventional boards having no exploded bark.

The term "lignin and polyphenols" as referred to in the disclosure and claims is meant to refer to lignin and polyphenols, as quantitatively determined by analysis before or after exploding the bark, which means that the lignin and phenols after exploding the bark may have somewhat different chemical structures but are not degraded to low sugars.

BACKGROUND OF THE INVENTION

Barks are generally considered wastes from commercial manufacturers.

Exploded wood is known, and so far, has been considered a curiosity rather than a tool to obtain new products having particular properties.

The prior art discloses steam explosion of wood, and also bark, but in order to extract the oils and sugars inherent to trees (wood and barks). These oils are for instance: fatty acids, fatty alcohols, fatty ketones, aromatic esters, aromatic acids, phenols and polyphenols, alkanes, alkenes. Normally oils and sugars represent about 30% of which about 15 to 20% are sugars. These sugars and phenols may be water-extracted and the oils solvent-extracted.

There is also disclosed in Canadian Patent 1,213,711 as invented by Shen, Ku-Cheng, dated Nov. 12, 1986, a process for converting lignocellulosic materials into composite products whereby, as stated on Page 4, penultimate paragraph, the inventor has disclosed that free sugars can be generated from hemicellulose in any lignocellulosic materials and be utilized as a bonding agent for reconstituted composite products. The inventor converts hemicellulose into free sugars, carbohydrates or saccharides by auto-hydrolysis.

As stated on Page 6 of the patent, "First, acetic acid is formed by cleavage of acetyl side chains, and the weak acidic environment thus created is sufficient to promote hydrolysis of hemicellulose. The depolymerization reaction is believed to be a sequential reaction. During the initial phase of the reaction process, random attack by acid in hemicellulose chains produces oligomers of varying degrees of polymerization. The oligomers are further hydrolyzed to monomers which are further degraded to furfural and other decomposition products. Simultaneously, the lignin portion of lignocellulosic materials is also decomposed and hydrolyzed to low molecular weight lignin and lignin products Only the cellulose remains relatively unchanged. The steam-treated lignocellulosic materials normally have about 20 to 30% of water solubles which contain sugars, sugar polymers, dehydrated carbohydrates, furfural products, lignin products. The free sugars, furfural, and other decomposition products are essential parts of the present invention. When chemically transformed under heat and pressure, they would thermoset and crosslink into a polymeric substance acting as both a bonding and bulking agent for the reconstituted composite products from the steam treated lignocellulosic materials."

BRIEF DESCRIPTION OF THE INVENTION

Broadly stated, the invention is directed to a method of making a shaped product containing exploded bark, preferably softwood bark, which comprises:

exploding bark obtain exploded bark, preferably softwood bark and most preferably softwood bark having at least 23% cellulose and at least 18% lignin polyphenols contents, compressing said exploded bark to obtain new shaped products and in part remove the water, and drying the shaped products to remove the remaining water.

In a particular embodiment, the invention is directed to the method of making a steam-exploded shaped product comprising:

steam-exploding softwood bark by steam-explosion at a temperature ranging from 150° to 210° during a period from 2 minutes, up to from 5 minutes when said temperature is about 210° C. to up to 8 minutes when said temperature is 150° C., to maximize the cellulose and lignin polyphenols contents of the bark, removing the water while shaping said drying bark under heat and pressure in order to obtain a unitary shaped product consisting essentially of exploded softwood bark.

In a preferred embodiment the invention is directed to the method of making a shaped product containing an exploded softwood bark which comprises:

steam-exploding softwood bark at a temperature from 150° C. to 210° C. during a period from 2 minutes, up to from 5 minutes when said temperature is about 210° C. to up to 8 minutes when said temperature is 150° C.

mixing wood fibers with said bark so exploded, removing in part water from the mixture of bark wood fibers thus obtained, compressing said mixture into a shaped product defining a board, thereby removing further water, and drying said board to remove the remaining water.

In another embodiment the invention comprises steam-exploding softwood bark as above, to obtain wet exploded bark having at least 23% cellulose content, and a water content of about 50 to 70%, mixing from 65 to 99% by weight of wood fibers, with from 1 to 35% by weight of said wet exploded bark to obtain a highly diluted dispersion having a consistency of about 1 to 2% solid in water, laying said diluted dispersion over a perforated surface in order to obtain a layer of wood fibers and bark, removing therefrom water until a mat is obtained, further removing water by exerting pressure and vacuum on said mat and drying said mat It should be noted that the 35% by weight of exploded bark could also be increased when a very high vacuum is used in order to remove the water.

The invention also comprises:

steam exploding said bark at a temperature ranging from 150° to 210° C., during a period from 2 minutes up to from 5 minutes when said temperature is about 210° C., to up to 8 minutes when said temperature is 150° C., mixing at least one compatible adjunct therewith and compressing said mixture into a shaped product defining a board, thereby removing further water, and drying said board to remove the remaining water.

If desired after steam exploding and before mixing, water may be removed in part from said bark so exploded.

The shaped product can take any form, molding, sheets, boards, tiles are for instance some of the species of that genus.

The drying is generally carried out to remove the remaining portion of the water to a level of about the ambient humidity, although, this is not essential.

The invention is also directed to various shaped products comprising exploded softwood bark, having at least 23% cellulose content, and at least 18% lignin and polyphenols contents, said % being on the dry weight basis of said bark.

THE EXPLOSION

By the terms "exploded" bark, "exploding" bark and "explosion" of bark, are meant compressing with a fluid under pressure and heat, bark for a given period of time, and then abruptly releasing the pressure to obtain by "explosion" fiber-like and powder like products, wherein the lignin and the polyphenols are spread on the surface of the fibers hereinafter referred to as "exploded bark" The conditions of temperature and duration of the explosion are set in order to maximize the cellulose, lignin and polyphenols contents as will be discussed hereinbelow and to prevent hydrolysis of hemicellulose and to prevent sugar formation and other degradation of the cellulose, lignin and polyphenols.

This process is preferably conducted by steam exploding at a temperature to open the bark while maximizing the production of cellulose. Pressurized steam is generally at a temperature between 21° and 150° C., preferably from 200° to 210° C. during 2 to 5 minutes is most preferred. Low temperatures to maximize cellulose production would be desirable, however, as the temperature is lowered below 200° C. the efficiency of the explosion of the bark to free the cellulose is reduced. Higher temperatures must be avoided, as they decrease the fiber length and degrade cellulose at the expense of non useful products as will be demonstrated hereinbelow.

In order to obtain the explosion of the bark, pressures as low as 50 psi and as high as 500 psi may be used. Preferably however, pressures of 200-300 psi or thereabout are conveniently used.

BRIEF DESCRIPTION OF THE DRAWING

Further features, objects and advantages will be evident following detailed description of the preferred embodiments of the present invention taken in conjunction with the accompanying drawings, in which.

DESCRIPTION OF A PREFERRED EMBODIMENT

Figure 1:
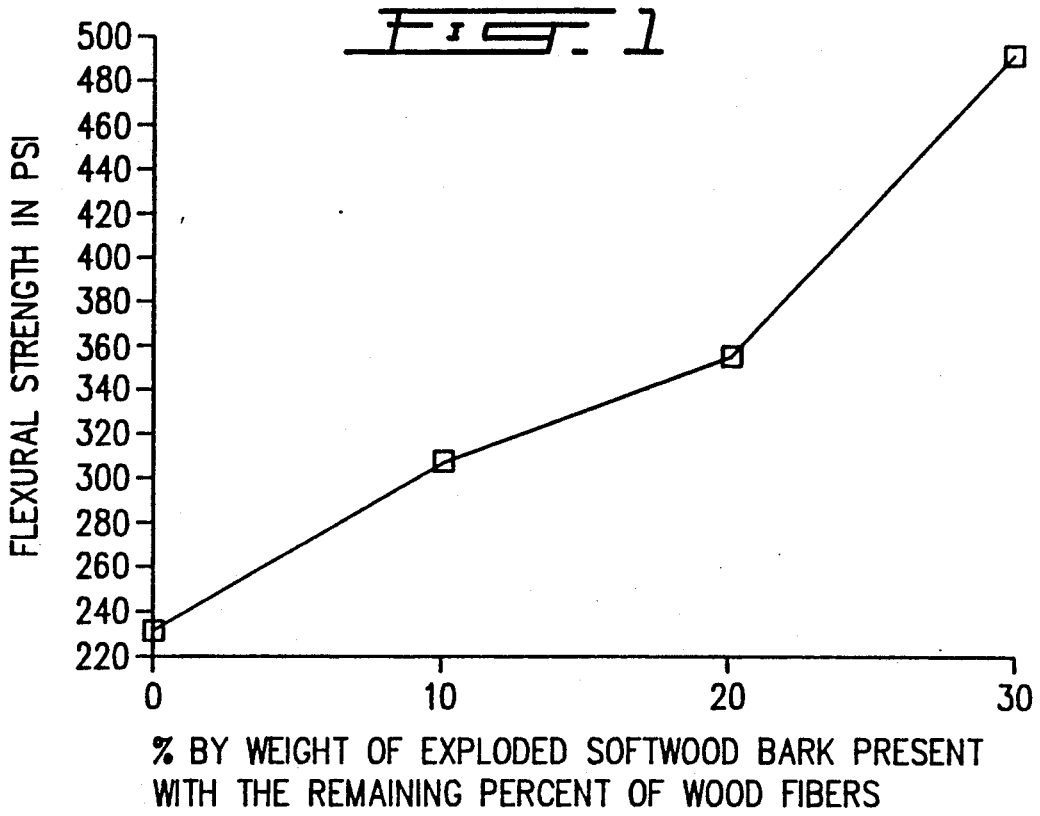
FIG. 1 is a graph representing the flexural strength of boards in psi (ordinate) versus the percentage by weight of exploded softwood bark (abscissa), in a board containing exploded softwood bark and wood fibers as described in Examples 1, 2, 3 and Sample A.

One of the preferred ways of carrying out the invention consists in steam exploding softwood bark at a temperature from 150° to 210° C., preferably from 200° to 210° C. during 2 to 5 minutes, to obtain a wet exploded softwood bark having at least 23% cellulose content, and a water content by weight of about 50 to 70%.

Thereafter, this wet exploded bark is mixed with from 65 to 99% by weight of wood fibers to obtain a highly diluted dispersion having a consistency of about 1 to 4%, preferably 1 to 2% solid. This consistency may also be more or less, if one desires. The wood fibers may be derived for instance from saw dust, wood shavings and the like, by digesting these shavings and/or saw dust, refining and de-fibering. The wood thus obtained in suspension can be mixed in a mixer with the wet exploded fibers. Other additives may be added, if desired.

From the mixer, the resulting mixture can be sent to a mat former having a reservoir provided partly therein with a rotatable drum, said drum having a perforated surface, whereby the mixture adheres to the perforated surface by a vacuum created inside the drum, such as with an Oliver TM filter machine As the drum rotates a mat is formed while water is removed. The mat so obtained is then displaced over a plurality of squeezing rollers while holding the mat between endless belts. Pressures of 3 to 80 psi may be used or even higher. The mat is then heat dried to remove the water, with a COE TM steam dryer to form a slab which is cut to the desired size.

If desired, this product can be sandwiched with papers or laminated. A board containing 100% bark product obtained by steam explosion is stronger than a 100% wood fiber board, generally made under the name : "hardwood or softwood-panels".

OTHER WAYS OF CARRYING OUT THE INVENTION

If desired, a thermomechanical treatment in aqueous continuous phase may be conducted. In such a system the bark is suspended in an aqueous system, homogenized i.e. well mix, pressurized, pressure released, thereby flashing out and filtered.

Although steam exploded bark is preferred, there are other ways as thermomechanical in vapour phase, using other compatible solvents in critical or supercritical phase instead of water to produce the explosion of bark Care should be taken by one skilled in the art, when solvents are used, is as to not affect the aims of this invention which is maximized cellulose formation as well as lignin formation.

Staketech which is a continuous process, as commercially available by Stake Technology Ltd., 208 Wyecroft Road, Oakville, Ontario, Canada, L6K 3T8, which converts lignocellulose by continuous steam displacement under pressure as high as 450 psi: For instance, at 450 psi during 1–4 minutes.

If desired, the oils and sugars which are inherent to trees and which represent about 30% by weight of the bark, may be removed by extraction before making a shaped product, however, this is generally less preferred because of possible loss of the low volatile materials experienced during such extractions. It may for instance be removed by steam distillation.

SHAPING

Pressures of 3 to 80 psi and more may be used to shape the exploded bark alone or with other compatible fragmented material adjuncts. Higher pressures are preferred, since at low pressures, the flexural strengths are less The product obtained at high pressures is more water impermeable, absorbing less water.

The pressure exerted on the exploded bark is the sole ingredient that produces the unitary formation of the shaped products. Yet it produces, without glues, resins or adhesives, the unitary shaped products, say a board having flexural strengths that is better than one with conventional wood fibers. The lignin on the cellulose fibers is the active ingredient that may be used to glue the cellulose fibers together. Also, the dimensional stability is improved. These products may be used in areas where particle boards are generally used, and are preferred to such particle boards.

MIXTURES CONTAINING EXPLODED BARK

Also seen above, the exploded bark could be mixed with compatible adjuncts which are fragmented material adjuncts which have no hindering effect on the purpose of the invention. As typical examples of compatible adjuncts are polymeric fragmented materials, for instance phenolic foam i.e. fully cross-linked or other foams if desired. Polyethylene, polyesters and other polymers could also be used. Also inorganic fragmented materials are contemplated, for instance gypsum (for instance 1 to 10% by weight of the board), cement, and the like The exploded bark can be mixed with cement into moldable products, for instance, in an amount ranging from 10 to 50% by weight of the board.

The exploded bark could also be mixed with wood pulp, using conventional methods, whether virgin or recycled (for instance 5–20%) to be shaped into a ply for a carton i.e. liner board and corrugated medium in the making of boxes. The exploded bark could also be shaped into a ply in the making of interior or exterior plywood. It could also be mixed with 60 to 90% wood pulp to make other useful products Low density panels as is well known having 0.16 to 0.42 g/cm$^3$ or 9.99 to 26.22 lb/ft$^3$. Medium density panels having 0.53 to 0.80 g/cm$^3$ or 33.09 to 49.94 lb/ft$^3$ and high density panels higher to said 0.8 g/cm$^3$ or 50 lb/ft$^3$ may be produced by exerting the necessary pressure when compressing into a shaped product.

The exploded bark could also be used for making interior ceiling felt, roofing tiles, interior and exterior sheathings, as well as for composite materials that are either laminated or molded.

The exploded softwood bark could also be mixed with hardwood bark, but in a preferred embodiment in an amount ranging from 1 to 35% of hardwood bark having more preferably a cellulose content of at least 11%.

Also exploded hardwood barks could be used with wood fibers for making panels.

OTHER TREATMENTS

It has also been found that a surface treatment, such as a quick treatment with 1% $H_2O_2$, NaOH or $H_2SO_4$, produces improved properties of the shaped product comprising exploded bark, such as flexural strength, dimensional stability, water absorption.

After explosion, the exploded bark can be used as such or treated as follows:

a) with oxidizing agents, for instance peroxides;
b) with a solvent to remove oils and other oil soluble products;
c) as in b) followed by a treatment as in a);
d) with a Lewis base, for instance NaOH, KOH;
e) as in b) followed by d);
f) with a solvent to remove sugars;
g) with a Lewis acid, such as sulfuric, acetic, hydro chloric.

For the above steps a) to g) the exploded barks are generally treated in an aqueous suspension for about 5 minutes to half an hour.

The exploded bark board could also be made by drying and then heat pressing the exploded bark, for instance at 3 psi during 5 minutes after vacuum filtration. The time and pressure can be extended, for pressures as high as 80 psi and more could be used.

EXAMPLES

The following examples will serve to illustrate in detail, particular embodiments of the invention.

EXAMPLES 1 TO 10

Various exploded bark boards (examples 1 to 10) were made as described under "Description of a preferred embodiment" hereinabove, with softwood fibers (WF), softwood bark (EB) steam exploded at 210° C. during 2 minutes and phenolic foam (PF) in various amounts, using pressures of about 3 psi.

As seen in Table 1, the dimensional stability, (Dimensional stab) in thickness (T), width (W) and the length (L) of the boards were evaluated at 90° C., 10% humidity during two weeks. The same order of results were obtained under a 50% humidity at 20° C., and 95% humidity at 30° C.

Also as shown in Table 2, the dimensional stability of the boards was measured after 3 weeks at a temperature of 30° C. under a 95% humidity.

Table 3 illustrates the dimensional stability obtained after 3 weeks at 90° C. and 10% humidity.

In each case as shown in Table 2 where the conditions are closer to normal condition, the dimensional stability is as good as or better than Sample A which is a standard fiberboard. Sample B has a PF:EB:WF ratio of 0:0:100 and is a commercially available fiberboard.

The density (D) of the boards in (lb/cu.ft) was obtained after the drying of the panels. The water absorption (Absorp.) was measured after submerging the panels in water at 25° C. for 2 hours, then the panels were left on a table for ½ hour at room temperature under normal humidity conditions prior to measuring their weights as per ASTM-C209. As can be seen, the density increases with the addition of exploded bark, while the water absorption decreases.

TABLE 1

| Example | PF:EB:WF | Dimensional stability T % | W % | L % | D lb/ft³ | Water Absorp. % Volume |
|---|---|---|---|---|---|---|
| 1 | 0:10:90 | 3.79 | 0.27 | 0.08 | 19.27 | 14.28 |
| 2 | 0:20:80 | 1.60 | 0.18 | 0.26 | 20.15 | 19.56 |
| 3 | 0:40:60 | 0.00 | 0.24 | 0.21 | 21.96 | 12.33 |
| 4 | 0:80:20 | 0.06 | 0.01 | 0.20 | 24.87 | 7.86 |
| 5 | 20:60:20 | 0.35 | 0.10 | 0.42 | 22.24 | 10.02 |
| 6 | 10:60:30 | 0.05 | 0.04 | 0.04 | 21.91 | 15.06 |
| 7 | 10:40:60 | 0.15 | 0.13 | 0.27 | 20.27 | 14.47 |
| 8 | 20:40:60 | 0.40 | 0.09 | 0.03 | 20.08 | 7.72 |
| 9 | 20:70:50 | 1.34 | 0.00 | 0.28 | 20.05 | 12.08 |
| 10 | 20:30:50 | 0.08 | 0.30 | 0.47 | 19.22 | 9.95 |
| Sample A | 0:0:100 | 0.20 | 0.05 | 0.16 | 16.84 | 16.49 |

TABLE 2

| Example | Dimensional stability T % | W % | L % |
|---|---|---|---|
| 1 | 5.80 | 0.42 | 0.42 |
| 2 | 6.06 | 0.48 | 0.48 |
| 3 | 4.19 | 0.25 | 0.28 |
| 5 | 1.87 | 0.60 | 0.38 |
| 6 | 3.09 | 0.27 | 0.36 |
| 7 | 4.05 | 0.51 | 0.54 |
| 8 | 2.10 | 0.35 | 0.37 |
| 9 | 2.40 | 0.69 | 0.86 |
| 10 | 3.22 | 0.31 | 0.27 |
| Sample A | 6.88 | 0.97 | 0.57 |
| Sample B* | 5.27 | 0.38 | 0.20 |

*Conventional panel

TABLE 3

| Example | Dimensional stability T % | W % | L % |
|---|---|---|---|
| 1 | 3.30 | 0.47 | 0.38 |
| 2 | 3.24 | 0.52 | 0.44 |
| 3 | 2.21 | 0.42 | 0.53 |
| 4 | 1.74 | 0.58 | 0.50 |
| 5 | 1.89 | 0.53 | 0.85 |
| 6 | 2.60 | 0.48 | 0.48 |
| 7 | 2.69 | 0.50 | 0.44 |
| 8 | 2.53 | 0.36 | 0.41 |
| 9 | 2.33 | 0.33 | 0.46 |
| 10 | 3.00 | 0.58 | 0.45 |
| Sample A | 3.82 | 0.46 | 0.43 |

The thermal reactivity (R) and the permeability (PERM) were also determined for some of the boards made as shown in Table 4.

TABLE 4

| PF/EB/WF | R | PERM. |
|---|---|---|
| 0:50:50 | 2.55 | 48.00 |
| 20:43:47 | 2.60 | 115.00 |
| Sample A | 2.62 | 61.00 |

As is easily seen on FIG. 1, and as compared against Sample A, the flexural strength increases somewhat at 30% exploded bark, 490 psi have been obtained in flexural strength as compared to 230 psi with 100% wood fibers board.

EXAMPLES 11-15

As seen in Examples 11, 12, 13 and Sample C, boards were made using various ratios of softwood exploded bark (EB), softwood fibers (WC), using a pressure of the order of 1 psi or there about to remove the water, and thereafter the remaining water was removed by dry heating. The exploded bark increases the flexural strength as can be seen from Table 5.

Two other panels were made (Examples 14 and 15) using same conditions as for Examples 11, 12, 13 except that the bark had been refluxed under water to remove the sugars and methanol to remove the oils. As can be easily seen, the flexural strength has little to do with the sugars and oils, the fibers and the lignin are the key components producing the flexural strength of boards. The density was also measured.

TABLE 5

| Example | EB:WF | Flexural strength (psi) | D (lb/ft³) |
|---|---|---|---|
| 11 | 27:73 | 121 | 12.45 |
| 12 | 33:67 | 119 | 13.64 |
| 13 | 47:53 | 138 | 17.56 |
| Sample C | 0:100 | 73 | 11.02 |
| 14 | 29:71 | 140 | 12.47 |
| 15 | 47:53 | 175 | 15.55 |

EXAMPLES 16 TO 19

The following examples illustrate the effect of temperature on the degradation of lignin and cellulose. As is easily seen from Table 6 hereinbelow good lignin and polyphenols spread on the surface of cellulose are noted in the 210° C. vicinity. At lower temperatures the lignin and the polyphenols are less available for the bonding property. At temperatures above 210° C. cellulose is severely degraded and to a lesser extent lignin, producing non-useful products such as sugars washed out by water.

TABLE 6

ANALYSES OF EXPLODED SOFTWOOD BARK*

| | Starting Material | Example 16 Residue | Example 17 Residue | Example 18 Residue | Example 19 Residue | Sample D Residue |
|---|---|---|---|---|---|---|
| Temperature of steam explosion | — | (130° C.) | (150° C.) | (180° C.) | (210° C.) | (230° C.) |
| Time in minutes | — | 2 | 2 | 2 | 2 | — |
| Part of residue dissolved in water containing sugars following washing with water | — | 28 | 32 | 44 | 50 | 59 |
| Lignin (NaOH) and Polyphenols | 25.4 | 24.9 | 21.6 | 18.6 | 18.7 | 15 |
| Cellulose | 31.85 | — | 28.2 | 26.2 | 23.1 | 19.0 |
| Pentosanes | 8 | 11 | 5 | 3 | 2 | 1 |

*(in % by weight based upon the weight of the starting material on a dry basis. (— not carried out)

TABLE 7

ANALYSES OF EXPLODED HARDWOOD BARK*

| | Starting Material | Example 20 Residue | Example 21 Residue | Example 22 Residue | Example 23 Residue | Sample E or 24 Residue |
|---|---|---|---|---|---|---|
| Temperature of steam explosion | — | (130° C.) | (140° C.) | (150° C.) | (180° C.) | (210° C.) |
| Time in minutes | — | 2 | 2 | 2 | 2 | 2 |
| Part of residue dissolved in water containing sugars following washing with water | — | 25 | 24 | 26 | 47 | 67.0 |
| Lignin (NaOH) and Polyphenols | 30 | 27 | 27 | 26 | 19.5 | 14.2 |
| Cellulose | 31.9 | 27.7 | 22.3 | 31.1 | 14.9 | 10.9 |
| Pentosanes | 14 | 12 | 10 | 6 | 7 | 2 |

*(in % by weight based upon the weight of the starting material on a dry basis (— not carried out)

EXAMPLES 20 TO 24

The same was repeated as in examples 16 to 19 and Sample D but using hardwood bark. The results shown in Table 7 were obtained. As in easily seen the steam explosion in the case of hardwood bark must be between 130° and 160° to maximize the cellulose, the lignin and the polyphenols content. However, as one skilled in the art knows, the lignin of hardwood bark and of softwood bark are chemically different.

Having described the invention, modifications will be evident of those skilled in the art without departing from the spirit of the invention, as defined in the appended claims.

Figure 2:
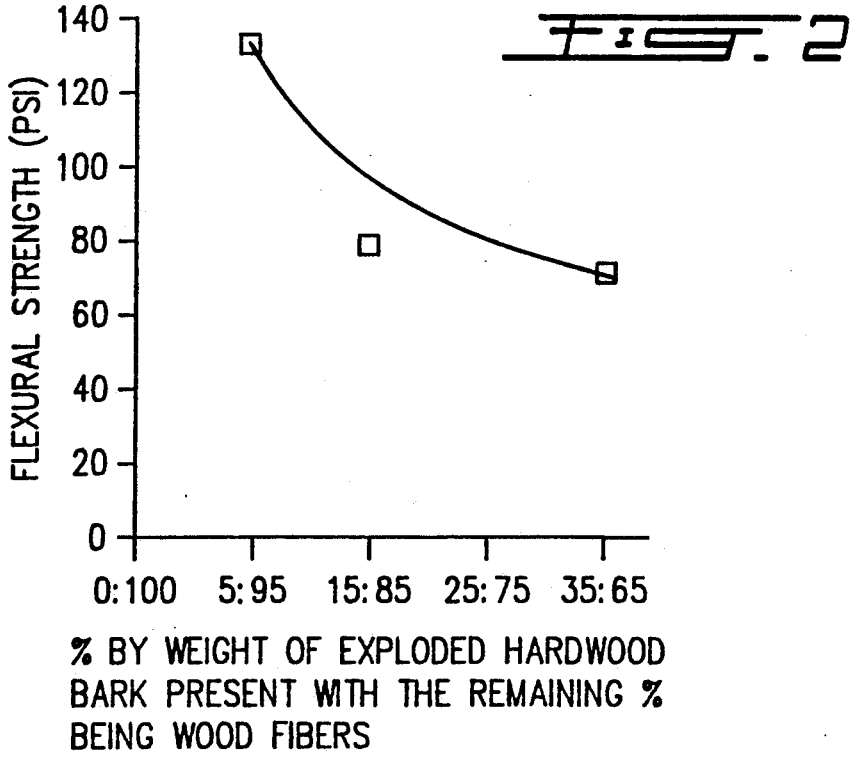
FIG. 2 is a graph representing the flexural strength of boards in psi (ordinate) versus the percentage by weight of exploded hardwood bark (abscissa), in a board containing exploded hardwood bark and wood fibers.

As a result boards were made as in Example 1-3 but with hardwood bark, steam exploded at 210° C. during 2 minutes and the results are tabulated in of FIG. 2 which clearly demonstrates the significant advantage of softwood exploded bark. However, steam-exploded hardwood bark can be successfully used within some limit in combination with softwood exploded as to make wood fiber boards.

EXAMPLES 25 TO 36

Various exploded bark boards were made with softwood fibers (WF), softwood bark steam exploded (EB) and in some cases (Examples 29 to 36 inclusive) with phenolic foam (PF) as a compatible fragmented adjunct. The flexural strengths (FS) of boards in psi were measured, and the percentage increase of flexural strength calculated in comparison with 25 which is a sample.

Results are shown in Table 8.

TABLE 8

| Example | EB:WF | FS | % increase in FS |
|---|---|---|---|
| Sample 25 | 0:100 | 231 | 0 |
| 26 | 10:90 | 306 | 40 |
| 27 | 20:80 | 355 | 54 |
| 28 | 40:60 | 492 | 113 |
| **Example** | **PF EB WF** | **FS** | **% increase in FS** |
| 29 | 20:40:60 | 235 | 2 |
| 30 | 20:60:20 | 298 | 29 |
| 31 | 20:30:50 | 313 | 35 |
| 32 | 20:43:37 | 231 | 0 |
| 33 | 14:50:36 | 287 | 24 |
| 34 | 10:60:30 | 298 | 29 |
| 35 | 9:36:55 | 300 | 30 |
| Sample 36 | 0:0:100 | 231 | 0 |

Having described the invention, numerous modifications will be evident to those skilled in the art without departing from the spirit of the invention, as defined in the appended claims.

The invention claimed is:

1. A method of making a pressed and dried shaped product containing exploded softwood bark which comprises:

exploding softwood bark to obtain exploded softwood bark having at least 23% cellulose and at least 18% lignin and polyphenols content, compressing said exploded bark to obtain a shaped product, using no other binder than the adhesives present in said exploded bark, and in part remove water, and drying the product to remove the remaining water.

2. The method of making a shaped product containing an exploded bark product as defined in claim 1, which comprises:

steam expolding said softwood bark by steam explosion at a temperature ranging from 150 to 210° C., during a period from 2 minutes up to 5 minutes when said temperature is about 210° C., to up to 8 minutes, when said temperature is 150° C., to maximize the cellulose and the lignin polyphenols contents of the bark, and removing the water, while shaping under heat and pressure said dried bark to obtain a unitary shaped product consisting essentially of exploded softwood bark.

3. The method of making a shaped product containing an exploded softwood bark as defined in claim 1, comprising:

steam exploding said bark at a temperature ranging from 150 to 210° C., during a period from 2 minutes up to from 5 minutes when said temperature is about 210° C., to up to 8 minutes when said temperature is 150° C., mixing wood fibers with said bark so exploded, removing in part water from the mixture of bark and wood fibers thus obtained, compressing said mixture into a shaped product defining a board, thereby removing further water, and drying said board to remove the remaining water.

4. The method as defined in claim 3 wherein a pressure between 50 and 500 psi is used for steam exploding.

5. The method as defined in claim 3 wherein a pressure between 200 and 300 psi is used for steam exploding.

6. The method of making a shaped product containing an exploded softwood bark boards as defined in claim 1, comprising:

steam exploding said bark at a temperature ranging from 150 to 210° C., during a period from 2 minutes up to from 5 minutes when said temperature is about 210° C., to up to 8 minutes when said temperature is 150° C., mixing at least one compatible adjunct therewith and compressing said mixture into a shaped product defining a board, thereby removing further water, and drying said board to remove the remaining water.

7. The method as defined in claim 6 wherein said adjunct is a member selected from the group consisting of phenolic foam gypsum board.

8. The method as defined in claim 6 wherein said adjunct is wood pulp and said mixture is shaped into a ply for the making of a carton.

9. The method as defined in claim 6 wherein said adjunct is an exploded hardwood bark.

10. The method as defined in claim 3 wherein the bark so exploded contains about 50 to 70% by weight water, and from 1 to 35% by weight of exploded softwood bark on a dry weight basis, is mixed with from 99 to 65% of wood fibers.

11. The method as defined in claim 3 wherein said water is removed in part from said mixture by passing it over a mat former.

12. The method as defined in claim 11 wherein after mat former, the mat is squeezed over a plurality of squeezing rolls while holding the mat between an endless belt to remove further water before drying to remove the remaining portion of the water to a level of about the ambient atmosphere.

13. The method as defined in claim 3 wherein the pressure for compressing said exploded bark ranges from 3 to 80 psi.

14. The method as defined in claim 3 wherein said shaping is carried out at about room temperature.

15. The method as defined in claim 3 wherein during said steam-exploding of said bark, said lignin and polyphenols within said bark emerge from said cellulose within said bark and melt thereon, said cellulose being thus in the form of fibers surrounded with said lignin and said polyphenols and glued therein.

16. The method of making a board product which comprises:

steam exploding softwood bark by steam explosion at a temperature ranging from 150 to 210° C. during a period from 2 minutes up to from 5 minutes when said temperature is 210° C., to up to 8 minutes when said temperature is 150° C., to maximize the cellulose and the lignin polyphenols contents of the bark to obtain wet exploded bark having at least 23% cellulose content, and a water content of about 50 to 70%, mixing from 65 to 99% by weight of softwood fibers, with from 1 to 35% by weight of said wet exploded bark to obtain a highly diluted dispersion having a consistency of about 1 to 2% solid in water, laying over a perforated surface said diluted dispersion to obtain a layer of a mixture of wood fibers and bark, removing therefrom water until a mat is obtained forming the mat using no other binder than the adhesives present in said exploded bark, further removing water by exerting pressure and vacuum on said mat, and drying said mat.

* * * * *